US005828931A

United States Patent [19]

May et al.

[11] Patent Number: 5,828,931

[45] Date of Patent: *Oct. 27, 1998

[54] COMPLIANT PHOTOCONDUCTIVE IMAGE MEMBER AND METHOD OF USE

[75] Inventors: John W. May, Rochester; Thomas N. Tombs, Brockport, both of N.Y.

[73] Assignee: Eastman Kodak Company, Rochester, N.Y.

[ * ] Notice: The term of this patent shall not extend beyond the expiration date of Pat. No. 5,715,505.

[21] Appl. No.: 655,656

[22] Filed: May 30, 1996

[51] Int. Cl.[6] ..... G03G 15/00

[52] U.S. Cl. ..... 399/159; 430/31

[58] Field of Search ..... 399/116, 159, 399/161, 162, 133, 308; 430/106.6, 109, 126, 111, 31, 47

[56] References Cited

U.S. PATENT DOCUMENTS

| | | | |
|---|---|---|---|
| 4,531,825 | 7/1985 | Miwa et al. . | |
| 4,990,969 | 2/1991 | Rapkin . | |
| 5,001,028 | 3/1991 | Mosehauer et al. . | |
| 5,070,372 | 12/1991 | Randall | 399/321 |
| 5,075,730 | 12/1991 | Hoshi | 399/302 |
| 5,084,735 | 1/1992 | Rimai et al. . | |
| 5,087,945 | 2/1992 | Randall . | |
| 5,200,285 | 4/1993 | Carrish | 399/302 X |
| 5,206,101 | 4/1993 | Schonenberg | 399/178 X |
| 5,243,392 | 9/1993 | Berks et al. | 399/308 |
| 5,339,146 | 8/1994 | Aslam et al. . | |
| 5,347,353 | 9/1994 | Fletcher . | |
| 5,370,961 | 12/1994 | Zaretsky | 399/130 X |
| 5,485,256 | 1/1996 | Randall et al. | 399/308 |
| 5,536,609 | 7/1996 | Jackson et al. | 430/47 |
| 5,561,510 | 10/1996 | Kamp et al. | 399/308 |

FOREIGN PATENT DOCUMENTS

| | | |
|---|---|---|
| 62-157045 | 7/1987 | Japan . |
| 2-024667 | 1/1990 | Japan . |
| 3-251860 | 11/1991 | Japan . |
| 3-251860 A | 11/1991 | Japan . |

*Primary Examiner*—S. Lee
*Attorney, Agent, or Firm*—Norman Rushefsky

[57] ABSTRACT

Toner images are formed electrophotographically on a photoconductive imaging member and electrostatically transferred to a receiving surface. Electrostatic transfer is improved with a photoconductive image member having a compliant layer with a Young's modulus less than $5\times10^7$ Pascals backing a thin photoconductive layer with a Young's modulus greater than $10^8$ Pascals. Preferably, the compliant layer is not more than 30 microns from the surface of the imaging member.

32 Claims, 6 Drawing Sheets

Fig. 1
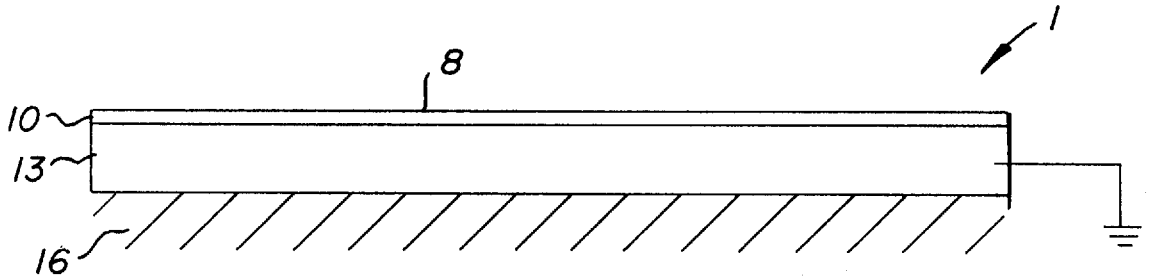
Fig. 2
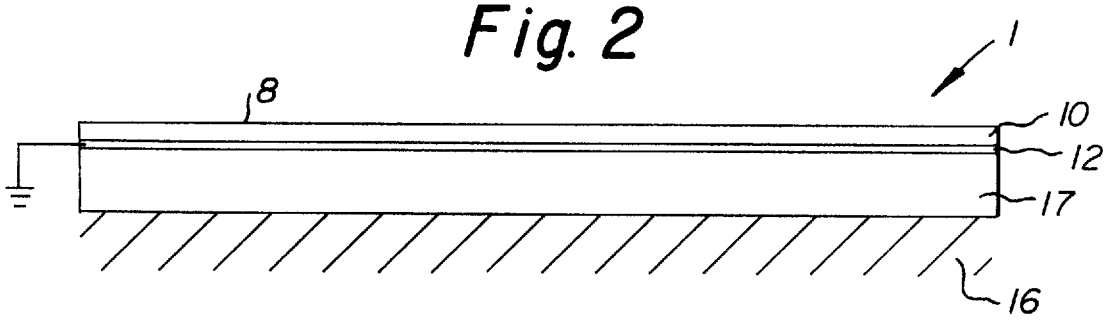
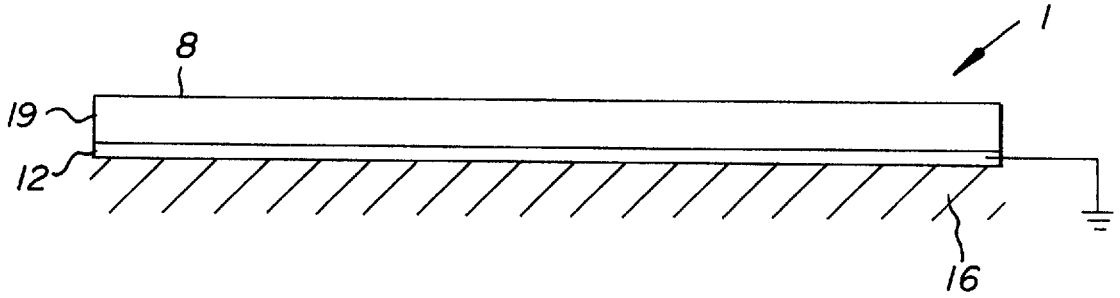
Fig. 3

COMPLIANT PHOTOCONDUCTIVE IMAGE MEMBER AND METHOD OF USE

CROSS-REFERENCE TO RELATED APPLICATION

This application is related to U.S. application Ser. No. 08/655,787 filed on even date herewith in the names of the inventors herein and entitled, 'Image Forming Method and Apparatus Utilizing A Compliant Image Member.'

This invention relates to electrophotography, although it is not limited thereto. It is particularly usable in improving the electrostatic transfer of toner images, especially multiple toner images (as in color electrophotography) transferred to an intermediate image member or a receiving sheet.

U.S. patent application Ser. No. 07/712,017, now U.S. Pat. No. 5,536,609 Jackson et al (see corresponding WIPO Publication US92/04444), shows the use of a compliant roller, pad or coating behind a photoconductive belt to assist thermal transfer of toner images to a receiving sheet carried by a metal roller. The advantage of the compliance behind the photoconductor is that it widens the nip for good thermal transfer allowing use of the hard, thermally conductive roller carrying the receiving paper. See also in this respect, U.S. Pat. No. 5,339,146 and U.S. Pat. No. 4,531,825 which also suggest some advantage in compliance associated with a photoconductive image member in transferring to a hard intermediate that is heated.

U.S Pat. No. 5,084,735 to Rimai et al, granted Jan. 28, 1992 suggests an intermediate image member having a compliant base and a very thin, hard outer layer which provides greatly improved electrostatic transfer, especially of fine particle toner images.

U.S. patent application Ser. No. 08/180,580, now U.S. Pat. No. 5,485,256 to Randall et al, discloses the use of a second photoconductive image member ancillary to a primary photoconductive image member in an image forming apparatus. The primary photoconductive image member is used to make black images at high speed and high volume. The secondary photoconductive image member provides accent color toner images which are transferred to the primary image member in registration with the black images. See also in this respect, U.S. Pat. No. 5,347,353 to Fletcher, issued Sep. 13, 1994, which shows a photoconductive intermediate image member which receives images from a series of photoconductive drums in registration. The photoconductive intermediate member can occasionally be used to add an image to the combined image when an unusual color is desired.

SUMMARY OF THE INVENTION

It is an object of the invention to provide an image forming method and apparatus with excellent electrostatic transfer of one or more toner images from photoconductive image member to another surface, for example, to an intermediate image member or a receiving sheet.

This and other objects are accomplished by a method and apparatus of forming a toner image on a photoconductive image member and transferring it electrostaticallly, wherein the photoconductive image member includes a compliant layer.

According to a preferred embodiment of the invention, a compliant photoconductive image member, inventive per se, has a compliant layer of material having a Young's modulus less than $5\times10^7$ Pascals and a thin photoconductive layer having a Young's modulus of $10^8$ Pascals or greater. Preferably, the photoconductive layer is less than 15 microns thick, for example, less than 10 microns thick and is not substantially distanced from the compliant layer. That is, while there may be a very thin conductive or electrical barrier layer, or the like, between them, no substantial support layer is positioned between them.

It is preferred that the compliant layer be near the chargeable surface of the image member, for example, not more than 30 microns from the chargeable surface. This allows the compliance to help provide intimate contact between toner being transferred and the surface to which it is being transferred. Preferably, the compliant layer is less than 15 microns from the chargeable surface.

Although the prior art suggests the use of compliance behind a photoconductive member for thermal transfer to allow use of a hard metallic heat conducting roller backing the surface to which the toner is being transferred, we have found that the use of a compliant photoconductive image member improves electrostatic transfer as well. Although not limited thereto, it particularly makes feasible the transfer of toner images between photoconductive image members. Transfer can also be improved to a non-photoconductive intermediate member, whether or not the intermediate has compliance, greatly expanding the available intermediates usable with the photoconductive member. Transfer to paper is also improved because the compliance of the photoconductive image member conforms to various paper roughnesses.

BRIEF DESCRIPTION OF THE DRAWINGS

FIGS. 1, 2 and 3 are cross-sections of alternative compliant photoconductive image members, partially schematic and not drawn to scale.

DESCRIPTION OF THE PREFERRED EMBODIMENTS

Figure 4:
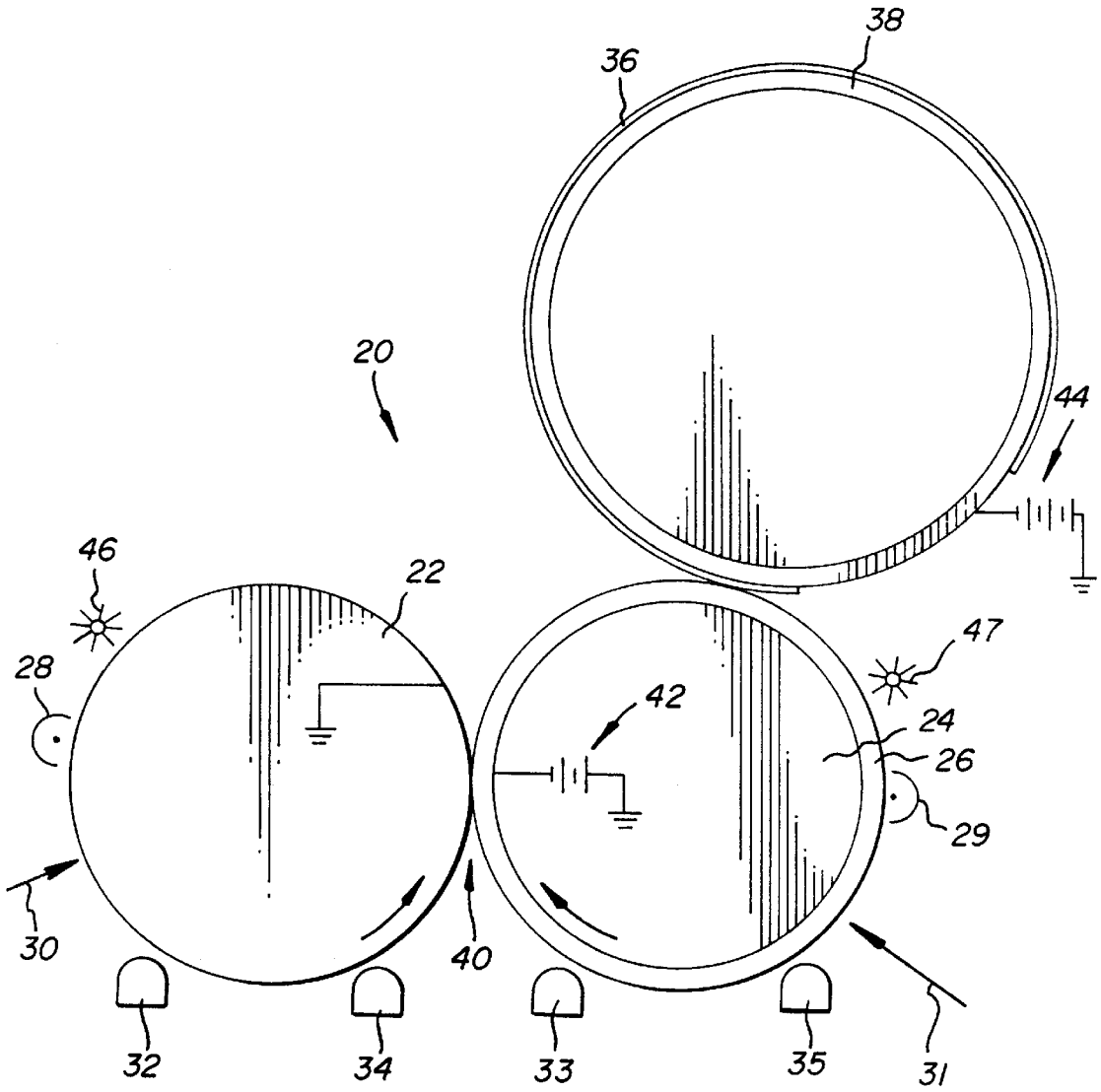
FIGS. 4–8 are side schematics of alternative image forming apparatus.

U.S. Pat. No. 5,536,609, referred to above, suggests several forms of compliant photoconductive image members. They include a drum upon which is wrapped a compliant blanket on top of which is wrapped a conventional web photoconductive image member, including generally a polyester support, a thin conductive layer and a photoconductive layer. While these photoconductive image members from the prior art work well in those applications and would provide some advantages in the electrostatic applications described below, embodiments described in FIGS. 1–3 provide much superior results.

The compliant photoconductive image member used in this invention can be in any of the general forms known for photoconductive image members in the prior art, including drum, endless belt, web or plate. Referring to FIG. 1, a base 16 which can be a polyester support, a metallic or glass drum, or the like, has coated thereon a relatively thick compliant layer 13. The compliant layer has also been doped with sufficient antistatic material to be sufficiently conductive to provide a backing electrode for use in an electrophotographic process. For example, a layer of polyurethane 0.5 to 10 mm thick doped with a conventional antistat used for polyurethane transfer drums can be used. The compliant material, whether polyurethane, silicone rubber or another compliant material, should have a Young's modulus of less than $5\times10^7$ Pascals, preferably between $10^6$ and $10^7$ Pascals.

Photoconductive layer (or layers) 10, as shown, defines a chargeable surface 8 on which a toner image is formed and is coated on the compliant layer 13. It is relatively thin, for example, less than 30 microns, preferably less than 15 microns in thickness. In some applications, it is desirable to let the photoconductive layer be thinner than 15 microns, for example, 7–10 microns thick. Although other thin layers may also be present on either side of the photoconductive layer, it is desirable that the compliant layer not be greater than 30 microns from the chargeable surface 8 of the image member. Preferably, that distance is less than 15 microns and, for some applications, between 7 and 10 microns.

Alternatively, as shown in FIG. 2, a non conductive compliant layer 17, with the same characteristics as in FIG. 1, can be used with a separate conductive coating 12 which can be quite thin, for example, less than 1 micron, as is commonly used in photoconductive belts. The thin photoconductive layer 10 (with the same characteristics as in FIG. 1) is coated on conductive layer 12. Practical considerations make this the preferred embodiment.

Alternatively, as shown in FIG. 3, a compliant photoconductive layer 19 can be coated on top of a conductive layer 12 on base 16 or directly onto a conductive base such as aluminum or the like. The FIG. 3 embodiment is somewhat more difficult to make, since photoconductive and compliant characteristics must be provided in a single layer. The compliant photoconductive layer is preferably 30–100 microns thick and has a Young's modulus less than $5\times10^7$ Pascals. Preferably, it is covered by a very thin, hard layer which can be insulative or photoconductive, and which is preferably less than 5 microns thick (especially, if not photoconductive) and has a Young's modulus greater than $10^8$ Pascals. If a hard overcoat is used, the compliant photoconductive layer 19 can be more compliant, preferably having a Young's modulus less than $10^7$ Pascals. In another embodiment, the structure of FIG. 3 may include an additional layer or layers (not shown), including a compliant layer under the compliant photoconductive layer 19. In this embodiment, the preferred thickness of layer 19 may be less than 30 microns.

Although FIG. 2 shows a thin conductive layer between the photoconductive layer 10 and the compliant layer, other thin layers, such as barrier layers or protective layers, may also be present on either side of the photoconductive layer. In all the embodiments, the photoconductive layer can include one or more separate charge generation layers, charge transfer layers, and the like. The number of layers is not critical, providing they are quite thin, allowing the effects of the compliant layer to be felt by the toner and the surface to which it is transferred.

Note that the normal organic photoconductive layer is generally quite hard. For example, it may have a Young's modulus well in excess of $10^8$ Pascals, for example, $10^{10}$ Pascals or more. We have found that superior transfer can be obtained when using an image member having a compliant layer with a thin, hard photoconductive coating on top of it (with or without a very thin conductive layer between and with or without a very thin hard overcoat).

Many electrophotographic processes combine toner images made originally with different toners. Although usually these processes provide two or more different colors to an image, they can also provide images with the same color toners but with different noncolor characteristics. For example, a multiple toner image combining a nonmagnetic and a magnetic black toner would also be a "combined" toner image.

As will be seen from the examples below, forming such combined toner images is conveniently accomplished using two photoconductive image members. More specifically, first and second toner images are formed on first and second photoconductive image members, respectively. The first toner image is transferred to the second photoconductive image member in registration with the second toner image to form a combined toner image. That combined toner image can then be transferred to a receiving sheet or otherwise used. In more sophisticated versions, more than one toner image can be formed on either or both of the image members and they can be transferred to the other image member in a single step or multiple steps.

A problem with such processes is that high quality and efficient transfer of a toner image from one photoconductive image member to another photoconductive image member is difficult to achieve. Electrostatic transfer can be substantially improved if at least one of the photoconductive image members is compliant, preferably conforming to the structures described in one of FIGS. 1–3.

FIGS. 4–8 show image forming apparatus and demonstrate processes in which a compliant photoconductive image member is particularly useful. In each instance, the image forming apparatus uses two photoconductive image members, one of which is compliant. One or more toner images is formed on each photoconductive image member and one or more toner images formed on one of the photoconductive image members is transferred to the other photoconductive image member in registration with one or more of the images formed on the second photoconductive image member. Either or both of the photoconductive image members is compliant. Preferably, the photoconductive image member that receives the toner images from the other photoconductive image member is compliant, which compliance can then be used in transferring the accumulated or combined images to another surface, for example, to paper.

Referring to FIG. 4, an image forming apparatus 20 includes a first photoconductive image member 22 and a second photoconductive image member 24. Second photoconductive image member 24 includes a compliant layer 26, preferably comparable to compliant layer 13 or compliant layer 17 in FIGS. 1 and 2, respectively. First photoconductive image member 22 may also have a compliant layer, but is shown in FIG. 4 without one. Both photoconductive image members 22 and 24 have thin, hard photoconductive layers at the surface of the image members (with or without a thin, hard overcoat). These photoconductive layers are so thin (for example, 7–15 microns) they are not shown in FIGS. 4–8.

Referring to FIG. 4, first photoconductive image member 22 is uniformly charged at a charging station 28 and imagewise exposed, for example, by a laser exposing device 30 to create an electrostatic image. The electrostatic image is developed by one of first and second development stations 32 and 34 to create a first toner image.

At the same time, second photoconductive image member 24 is similarly uniformly charged at a charging station 29, imagewise exposed at an exposing station, for example, a laser exposing station 31 and developed by one of third and fourth developing stations 33 and 35 to form a second toner image on the second photoconductive image member 24.

The first toner image is transferred from the first photoconductive image member 22 to the second photoconductive image member 24 in registration with the second toner image at an electrostatic transfer nip 40. This transfer to the second photoconductive image member 24 is accomplished under an electrostatic field between the two image members controlled by a potential applied from a potential source 42, having a potential opposite to that of the toner. The first photoconductive image member 22 has a conductive layer which is grounded.

The combined toner image, i.e., the image formed when the first toner image is transferred in registration with the second toner image, is transferred in one step to a receiving sheet 36 which has been affixed to a transfer drum 38. This transfer is controlled by an electric field between members 24 and 38 controlled by a voltage source 44, applied to transfer roller 38, and voltage source 42. Both image members are cleaned by suitable cleaning devices 46 and 47, respectively, so that the process can be continuous.

Thus far, the image forming apparatus 20 has provided a combined toner image made up of first and second toner images on receiving sheet 36. Two other images may be added to this by repeating the process but using the other of toning stations 32 and 34 and toning stations 33 and 35 to form a second combined image on second photoconductive image member 24, which is then transferred in registration with the first combined toner image on receiving sheet 36 as transfer roller 38 executes another revolution.

Figure 5:
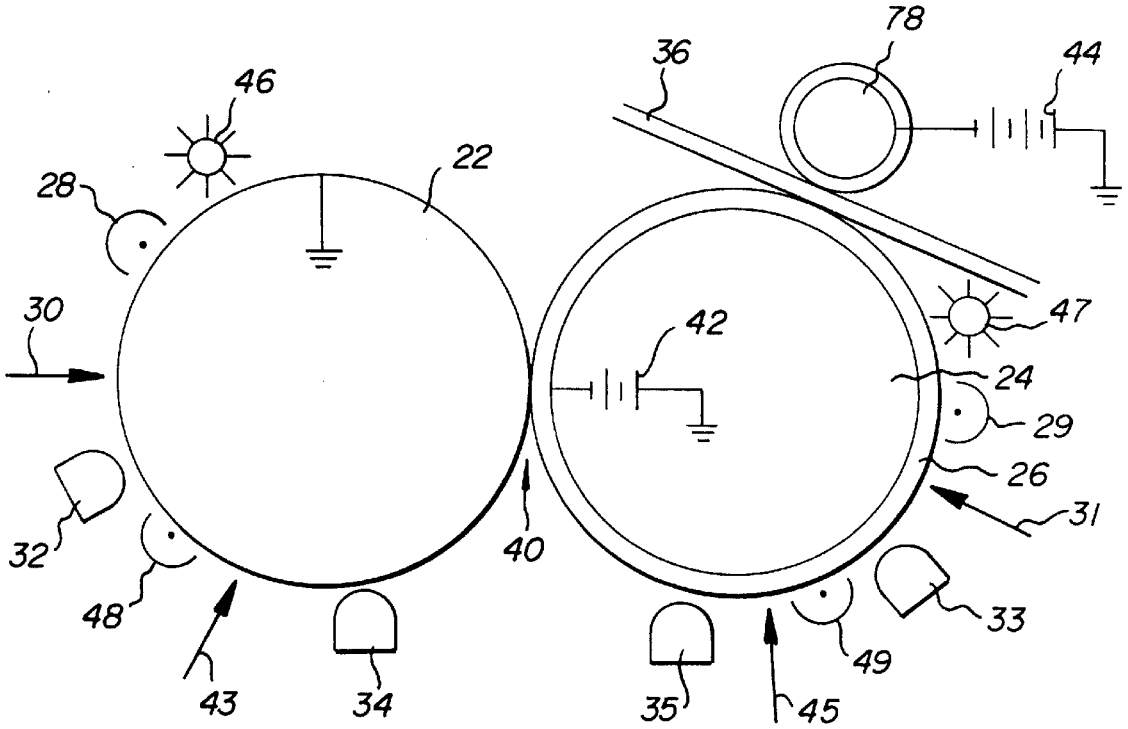

Referring to FIG. 5, a four toner combined image can be formed with increased productivity over the FIG. 4 device, by applying known technology to the FIG. 4 embodiment (see U.S. Pat. No. 5,001,028, issued Mar. 19, 1991 to Mosehauer et al). The first and second toner images as in FIG. 4 are formed by charging, exposing and developing devices 28, 30 and 32 and 29, 31 and 33, respectively. However, the third image is formed directly on top of the first image prior to transfer and the fourth toner image is formed directly on top of the second toner image prior to receiving transfer from the first photoconductive image member 22. More specifically, after the first toner image is formed on photoconductive image member 22, photoconductive image member 22 is charged by a charging station 48 and imagewise exposed by a suitable exposure device 43 to create a third electrostatic image which is then toned by third toning station 34 to create a combined toner image on photoconductive image member 22. Similarly, charging, exposing and developing stations 49, 45 and 35, respectively, are used to form another toner image on top of the second toner image already formed on image member 24. The combined toner image on image member 22 is then transferred to photoconductive image member 24 at transfer nip 40 as in FIG. 4 in registration with the combined toner image formed on image member 24 to now form a combined toner image that includes all four images. This combined toner image is transferred in a single step to receiver 36 as backed by a transfer backing roller 78.

This approach has advantages over that shown in FIG. 4 in that it can provide a four color toner image to receiving sheet 36 at full process speed and without wrapping the receiving sheet 36 around the transfer roller 38 to register images. On the other hand, this process is challenging in toning a second electrostatic image in the presence of an unfixed first toner image on each of the two photoconductive image members.

The use of two photoconductive image members, in addition to other advantages which will be set out below, in the process of FIG. 5, provides a four color image at full process speed but without toning an electrostatic image on top of more than one earlier toner image.

Figure 6:
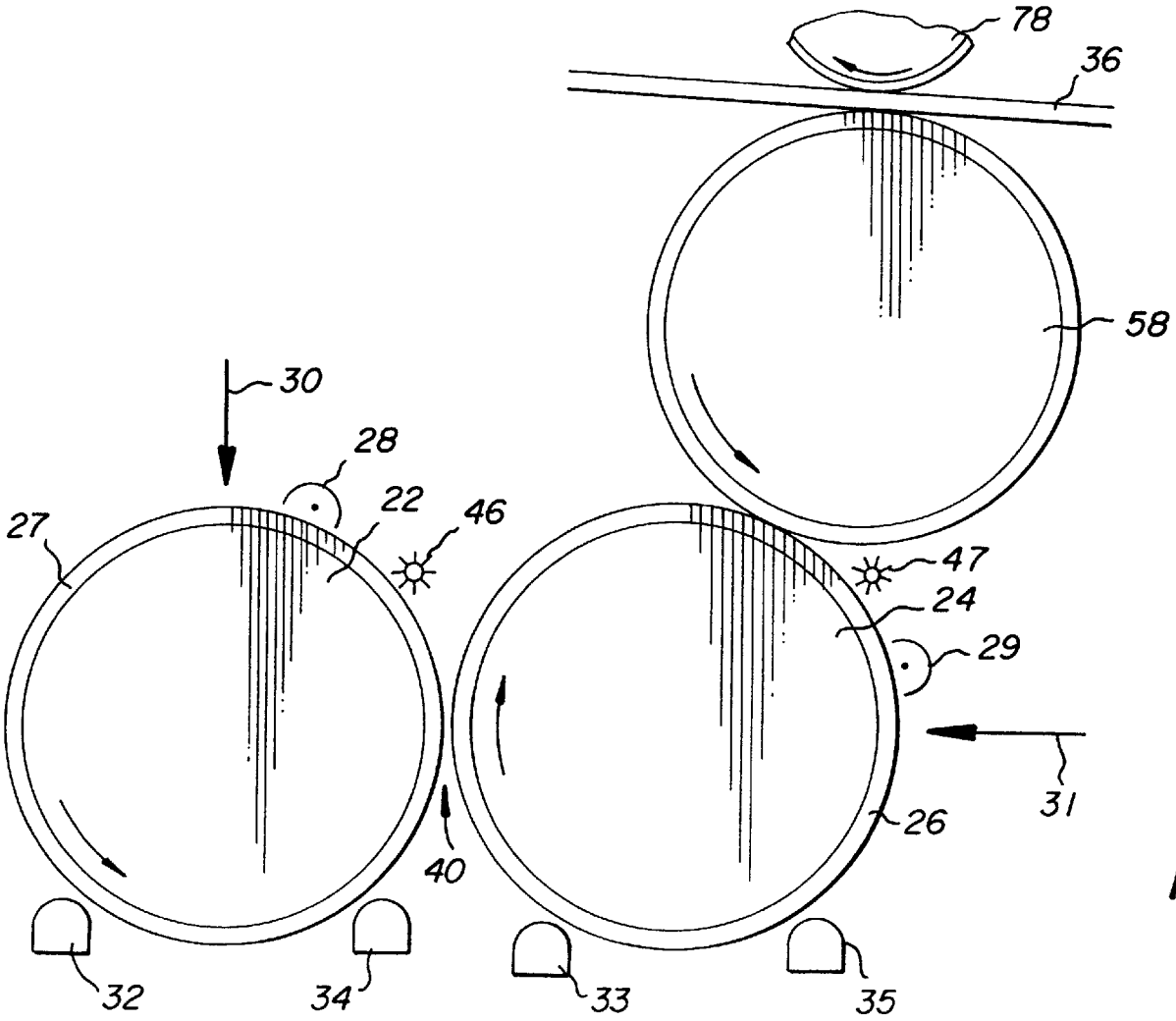

FIG. 6 shows a variation on the FIG. 4 approach with power supplies omitted for clarity. Both of the two combined toner images are formed on image member 24 as in FIG. 4. However, the first one is transferred first to an intermediate roller 58. The second combined toner image is later transferred from second photoconductive image member 24 to intermediate roller 58 in registration with the first combined toner image and the four image combined image is then transferred from intermediate roller 58 to receiving sheet 36 in a single step.

A compliant layer 27 is shown on first photoconductive image member 22, as well as the compliant layer 26 on photoconductive image member 24. The use of compliance in both photoconductive image members further increases the size of the nip 40 improving electrostatic transfer there. A compliant layer is also shown in intermediate roller 58 which improves the transfer of the combined toner image to the receiving sheet 36. Transfer backing roller 78 (articulatable in this embodiment) supports sheet 36 during transfer to it. Although compliance is shown on all three members 22, 24 and 58, less than all three could be compliant and still obtain the advantages of the invention, for example, member 58, with either 22 or 24, provides excellent results.

Figure 7:
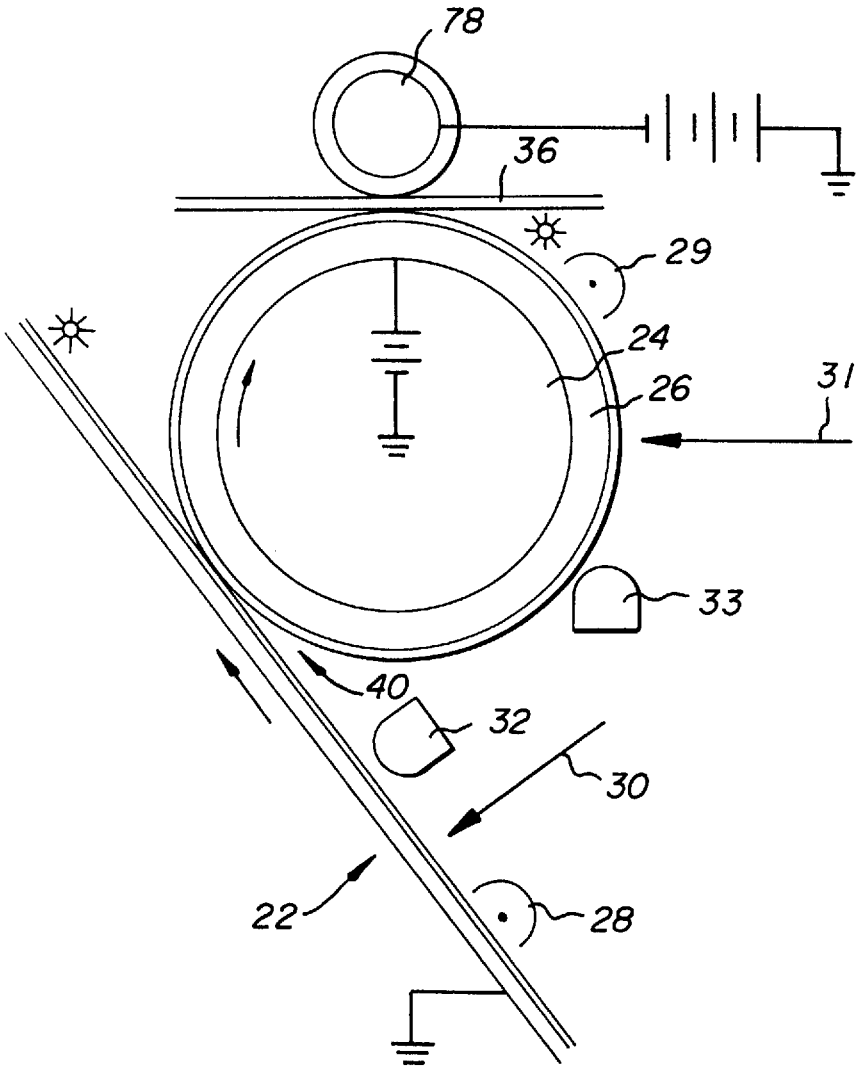

FIG. 7 shows a two color embodiment similar to that shown in FIG. 4 in which the first photoconductive image member 22 is a belt and the second photoconductive image member 24 is a drum. In this instance, the process is set up primarily to do single color accent color imaging. That is, toning station 33 tones the electrostatic images formed on the second photoconductive image member 24 with black toner and is the primary image member used in the image forming apparatus. When accent color is desired along with the black first color, the first photoconductive image member 22 is utilized to provide, for example, a red toner image which is transferred in registration with the black toner image at nip 40 to form the combined toner image on second photoconductive image member 24. As in some of the other embodiments, the combined toner image is transferred in a single step to the receiving sheet 36 backed by transfer backing roller 78. It is important that one or both of the image members 22 and 24 are compliant as described in FIGS. 1–3 to facilitate transfer at nip 40. If image member 24 is compliant (preferred), that compliance helps in the transfer to paper 36 by conforming to the roughness of the paper.

Figure 8:
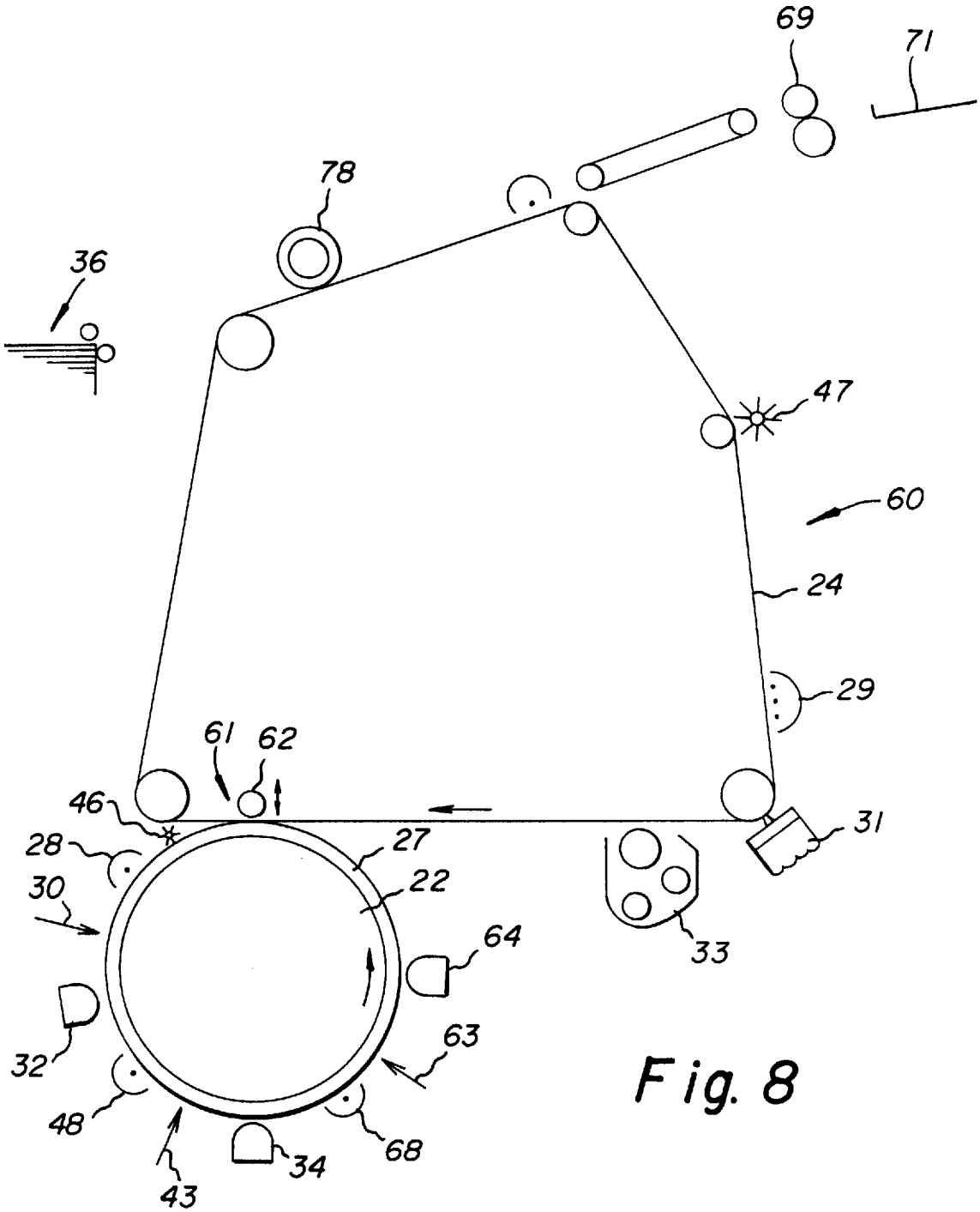

FIG. 8 shows a large high volume image forming apparatus, for example, a printer or a copier 60, in which the invention can advantageously be used. Referring to FIG. 8, and following the nomenclature of the earlier FIGS., the second photoconductive image member 24 is in the form of an endless belt trained about a series of rollers to continuously provide black images at high speed. It is charged by charging station 29, imagewise exposed by exposing station 31, shown as an LED printhead, to create electrostatic images. Each image is toned by a toning station 33 which, preferably, applies black toner to the image. In much operation the black image alone is transferred to the receiving sheet 36 using transfer backing roller 78. The receiving sheet is separated from the second photoconductive image member 24 and transported to fusser 69 and ultimately deposited in output tray 71.

For accent color images the first photoconductive image member 22 is in the form of a drum. Utilizing the same process used with respect to the structure shown in FIG. 5, either one, two or three accent color images can be formed in the same frame on image member 22. That one image or combination of images is then transferred in a single step in registration with the black image already on the second photoconductive image member 24 at transfer station 61. A backing roller 62 can be movable vertically, as shown, to urge the second photoconductive image member 24 into transfer relation with the first photoconductive image member 22 when accent color images are being made or to allow the tension of member 24 to position it slightly separated from member 22 when only black images are being made.

According to the invention, in FIG. 8 at least one of the two photoconductive image members is compliant. In FIG. 8 that compliance is shown in the first photoconductive image member 22 as compliant layer 27.

This structure provides three color accent colors at full process speed with a black core engine that is designed for high volume use in making black images. In addition to its other advantages, it has the advantage of being readily adapted to modular type construction with the accent color feature being added to the primary black engine when desired by the customer.

If the second photoconductive image member 24 is compliant, in addition to assisting transfer at nip 61, such compliance also assists transfer to paper or another receiving sheet at backing roller 78.

In all of the above examples the compliant layer on a photoconductive image member having that layer should have a Young's modulus less than $5\times10^7$ Pascals, preferably much less, for example, $10^6$ to $10^7$ Pascals. For best results in transfer at nip 40 the photoconductive layer overlying the compliant layer should be as thin as possible and still maintain sufficient photographic speed for the process and should be significantly harder than the compliant underlayer. Although a photoconductive layer 15 to 10 microns thick having a Young's modulus in excess of $10^8$ Pascals provides excellent results, even further improvement can be obtained if the photoconductor is somewhat thinner, for example, as thin as 7 to 15 microns.

In addition to the many advantages mentioned above, when the FIGS. 4–7 embodiments are used with two drums, combining two, three or four images, registration is considerably easier than when two separate photoconductive image members are used to transfer to a third member, for example, an intermediate or a receiving sheet, as is known in the prior art.

Note that the second photoconductive image member functions both as an imaging photoconductive member and as an intermediate to receive an image made elsewhere. It, thus, has a bi-functional property in the process. It is preferably compliant, although some of the examples show the first photoconductive image member being compliant instead of or in addition to the second photoconductive image member.

When the first photoconductive image member is compliant, it can provide electrostatic transfer advantages, especially when transferring to a non-compliant, non-photoconductive member such as a hard intermediate member or a hard receiver (for example, glass, metal or paper). When transferring directly to paper or other hard surfaces, a "microconformance" is provided by the FIGS. 1–3 structures that ensures thorough toner-paper contact which helps provide efficient transfer. It also helps transfer in the vicinity of carrier particles and other debris that occasionally are present in the transfer nip, and greatly reduces "hollow character" problems in such transfer. If this is used for full color reproductions, the microconformance helps provide such contact despite substantial variation in toner stack height typical of multiple color images. Thus, a compliant photoconductive image member has general use in electrostatic transfer, regardless of the member transferred to.

The invention has been described in detail with particular reference to a preferred embodiment thereof, but it will be understood that variations and modifications can be effected within the spirit and scope of the invention as described hereinabove and as defined in the appended claims.

We claim:

1. A photoconductive image member comprising:

a layer of compliant material having a Young's modulus of less than $5\times10^7$ Pascals, and a photoconductive layer having a Young's modulus of at least $10^8$ Pascals and which is thinner than the layer of compliant material.

2. A photoconductive image member according to claim 1 wherein the compliant material has a Young's modulus of less than $10^7$ Pascals.

3. A photoconductive image member according to claim 1 wherein the compliant material has a Young's modulus between $10^6$ and $10^7$ Pascals.

4. The photoconductive image member of claim 1 wherein the photoconductive layer is less than 30 microns thick.

5. A photoconductive image member of claim 4 further including a conductive layer between the compliant and photoconductive layers.

6. A photoconductive image member having a chargeable surface on which a toner image is formable, comprising:

a layer of compliant material having a Young's modulus of less than $5\times10^7$ Pascals, one or more layers positioned on said layer of compliant material, said one or more layers including at least one photoconductive layer having a Young's modulus of at least $10^8$ Pascals, and said one or more layers being sufficiently thin that the layer of compliant material is not more than 30 microns from the chargeable surface of the image member.

7. A photoconductive image member according to claim 6 wherein the at least one photoconductive layer has a Young's modulus of at least $10^{10}$ Pascals.

8. A photoconductive image member according to claim 7 wherein the at least one photoconductive layer is between 7 and 15 microns thick.

9. A method of forming a toner image on a receiving surface comprising:

forming an electrostatic image on a photoconductive image members, the image member including a layer of compliant material having a Young's modulus of less than $5\times10^7$ Pascals, and a photoconductive layer that is thinner than the layer of compliant material and having a Young's modulus of at least $10^8$ Pascals, and electrostatically transferring the toner image to the receiving surface by forming a nip between the photoconductive image member and the receiving surface and applying an electrical field to the nip of a direction urging transfer of the toner image to the receiving surface.

10. A method according to claim 9 wherein the receiving surface is a surface of a receiving sheet backed by a backing member.

11. A method according to claim 9 wherein the receiving surface is a surface of an intermediate member.

12. A photoconductive image member comprising a conductive layer and a compliant photoconductive layer having a Young's modulus of less than 5×107 Pascals.

13. A photoconductive image member according to claim 12 wherein the compliant photoconductive layer is covered by a hard layer of insulative material and the compliant photoconductive layer has a Young's modulus less than $10^7$ Pascals, the hard layer being thinner than the photoconductive layer and having a Young's modulus greater than that of the photoconductive layer.

14. A photoconductive image member according to claim 12 wherein the compliant photoconductive layer is covered by a hard layer of photoconductive material and the compliant photoconductive layer has a Young's modulus less than $10^7$ Pascals, the hard layer being thinner than the compliant photoconductive layer and having a Young's modulus greater than that of the compliant photoconductive layer.

15. A photoconductive image member comprising a conductive base and a compliant photoconductive layer having a Young's modulus of less than $5\times10^7$ Pascals.

16. A photoconductive image member according to claim 15 wherein the compliant photoconductive layer is covered by a, hard layer of insulative material and the compliant photoconductive layer has a Young's modulus less than $10^7$ Pascals, the hard layer being thinner than the compliant photoconductive layer and having a Young's modulus greater than that of the compliant photoconductive layer.

17. A photoconductive image member according to claim 15 wherein the compliant photoconductive layer is covered by a hard layer of photoconductive material and the compliant photoconductive layer has a Young's modulus less than $10^7$ Pascals, the hard layer being thinner than the compliant photoconductive layer and having a Young's modulus greater than that of the compliant photoconductive layer.

18. A photoconductive image member according to claim 15 wherein the compliant photoconductive layer is covered by a thin, hard layer of photoconductive material and the compliant photoconductive layer has a Young's modulus less than $10^7$ Pascals.

19. A photoconductive image member according to claim 5 and wherein the conductive layer is less than one micron in thickness.

20. A photoconductive image member according to claim 4 wherein the layer of compliant material is conductive and has a thickness of between 0.5 mm and 10 mm.

21. A photoconductive image member according to claim 5 wherein the layer of compliant material is non-conductive and has a thickness of between 0.5 mm and 10 mm.

22. A photoconductive image member according to claim 5 wherein the compliant layer is nonconductive.

23. A photoconductive image member according to claim 1 wherein the photoconductive layer is between 15 microns and 30 microns thick.

24. A photoconductive image member according to claim 5 wherein the photoconductive layer is between 7 microns and 15 microns thick.

25. A photoconductive image member according to claim 1 wherein the photoconductive layer is between 7 microns and 15 microns thick.

26. A photoconductive image member according to claim 1 and wherein the photoconductive layer is covered by a hard layer of insulative material that has a Young modulus greater than $10^8$ Pascals and the hard layer is thinner than the photoconductive layer.

27. A photoconductive image member according to claim 1 and wherein the photoconductive layer includes a charge generation layer and a charge transfer layer.

28. A photoconductive image member according to claim 1 and wherein the photoconductive layer is less than 15 microns thick and a chargeable surface of the image member is not more than 30 microns from the layer of compliant material.

29. A photoconductive image member according to claim 1 wherein the layer of compliant material is conductive and has a thickness of between 0.5 mm and 10 mm.

30. A photoconductive image member according to claim 29 and wherein the photoconductive layer is covered by a hard layer of insulative material that has a Young modulus greater than $10^8$ Pascals and the hard layer is thinner than the photoconductive layer.

31. A photoconductive image member according to claim 29 and wherein the photoconductive layer includes a charge generation layer and a charge transfer layer.

32. A photoconductive image member according to claim 29 and wherein the photoconductive layer is less than 15 microns thick and a chargeable surface of the image member is not more than 30 microns from the layer of compliant material.

* * * * *